FIP7811 XR 4,017,119

United States Patent [19]

Lewis

[11] 4,017,119

[45] Apr. 12, 1977

[54] METHOD FOR RUBBLIZING AN OIL SHALE DEPOSIT FOR IN SITU RETORTING

[75] Inventor: Arthur E. Lewis, Los Altos, Calif.

[73] Assignee: The United States of America as represented by the United States Energy Research and Development Administration, Washington, D.C.

[22] Filed: Mar. 25, 1976

[21] Appl. No.: 670,478

[52] U.S. Cl. ..... 299/2; 102/23; 299/4; 299/13

[51] Int. Cl.[2] ..... E21B 43/26; E21C 41/10

[58] Field of Search ..... 299/2, 3, 13; 102/23, 102/21; 166/259, 299, 271

[56] References Cited

UNITED STATES PATENTS

| | | | |
|---|---|---|---|
| 3,316,020 | 4/1967 | Bergstrom | 299/2 |
| 3,434,757 | 3/1969 | Prats | 299/13 X |
| 3,460,867 | 8/1969 | Cameron et al. | 299/2 |
| 3,537,753 | 11/1970 | Arendt | 299/2 |
| 3,917,346 | 11/1975 | Janssen | 299/2 X |
| 3,917,348 | 11/1975 | Janssen | 299/13 |

*Primary Examiner*—Stephen J. Novosad
*Attorney, Agent, or Firm*—Dean E. Carlson; Roger S. Gaither; Clifton E. Clouse

[57] ABSTRACT

A method for rubblizing an oil shale deposit that has been formed in alternate horizontal layers of rich and lean shale, including the steps of driving a horizontal tunnel along the lower edge of a rich shale layer of the deposit, sublevel caving by fan drilling and blasting of both rich and lean overlying shale layers at the distal end of the tunnel to rubblize the layers, removing a substantial amount of the accessible rubblized rich shale to permit the overlying rubblized lean shale to drop to tunnel floor level to form a column of lean shale, performing additional sublevel caving of rich and lean shale towards the proximate end of the tunnel, removal of a substantial amount of the additionally rubblized rich shale to allow the overlying rubblized lean shale to drop to tunnel floor level to form another column of rubblized lean shale, similarly performing additional steps of sublevel caving and removal of rich rubble to form additional columns of lean shale rubble in the rich shale rubble in the tunnel, and driving additional horizontal tunnels in the deposit and similarly rubblizing the overlying layers of rich and lean shale and forming columns of rubblized lean shale in the rich, thereby forming an in situ oil shale retort having zones of lean shale that remain permeable to hot retorting fluids in the presence of high rubble pile pressures and high retorting temperatures.

10 Claims, 8 Drawing Figures

METHOD FOR RUBBLIZING AN OIL SHALE DEPOSIT FOR IN SITU RETORTING

ORIGIN OF THE INVENTION

The invention disclosed herein was made under, or in, the course of Contract No. W-7405-ENG-48 with the United States Energy Research and Development Administration.

BACKGROUND OF THE INVENTION

The present invention relates to an improved method for preparing an oil shale deposit for in situ retorting, and more particularly it relates to a method for rubblizing and mixing rich and lean shale by the introduction of lean rubble columns in rich rubble layers to form an in situ retort in which hot fluid flow paths in the rubblized shale are maintained open under high rubble pile pressures and the presence of high retorting temperatures, both of which tend to cause plastic flow of the rich shale rubble.

The only method deemed practical by the industry for obtaining oil from oil shale is to heat the shale to the temperature at which the kerogen in the shale decomposes to yield shale oil, gas, and residue. Because oil shale is a poor conductor and is essentially impermeable before retorting, it is necessary to provide both heat transfer surfaces and space for the circulation of a hot fluid. This can best be done by introducing both fractures and space into the oil shale, a process which is referred to as rubblization. Fractures alone provide a surface but no room to circulate a hot fluid.

For surface retorts, adequate rubblization is easily achieved by mining and crushing to a suitable size. In situ rubblization is more difficult technically but has potential economic and environmental advantages. One problem is in providing fragments of suitable size with sufficient space between them to allow circulation of a hot fluid at modest pressure differences. If the fragments are too large, they will take too long to heat; if too many fine fragments are present the pressure drop required for fluid circulation will be too large for a given void space. Void space must be adequate for circulation of fluids but should be kept low to minimize costs. Another problem is the tendency of rich rubblized oil shale to undergo plastic flow under high rubble pile pressures and high retorting temperatures, thereby clogging the space between shale fragments and blocking the free flow of the hot fluid required for the extraction of oil shale products.

SUMMARY OF THE INVENTION

In brief, the present invention is an improved method for preparing an oil shale deposit for in situ retorting where the deposit is comprised of alternate layers of rich and lean shale. Rich shale typically contains around 25 or more gallons of oil per ton of shale, while lean shale typically contains less than 15 gallons per ton of shale. The method includes the steps of providing a vertical access tunnel in the deposit, drilling a generally horizontal tunnel from the access tunnel into the deposit, performing sublevel caving of both rich and lean layers overling the distal end of the tunnel to rubblize the layers, removing a sufficient amount of accessible rubblized shale in the tunnel to permit the overlying rich or lean shale to drop to tunnel floor level to form a column of shale that is different from the adjacent shale rubble, and performing additional sublevel caving and shale rubble removal to form additional columns and thereby provide alternate zones of rich and lean rubblized shale.

It is an object of the invention to rubblize an oil shale deposit in situ so that the shale rubble remains permeable to hot fluids during in situ retorting.

Another object is to rubblize in situ an oil shale deposit that is comprised of alternate layers of lean and rich shale and to mix the lean and rich shale during the rubblization.

Another object is to rubblize and mix in situ rich and lean layers of an oil shale deposit by subsurface mining including sublevel caving and partial extraction of the shale.

Another object is to monitor and optimize the size of oil shale fragments in rubblizing an oil shale deposit in situ.

Other objects and advantageous features of the invention will be apparent in a description of a specific embodiment thereof, given by way of example only, to enable one skilled in the art to readily practice the invention, the embodiment being described hereinafter with reference to the accompanying drawings.

DESCRIPTION OF AN EMBODIMENT

Figure 1:
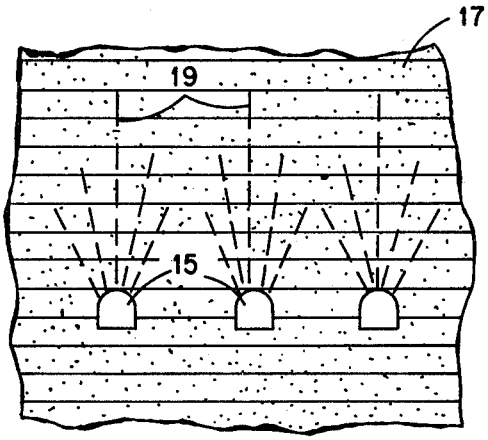
FIG. 1 is a cross-sectional transverse view of several horizontal tunnels driven in an oil shale deposit with a fan of holes driven upward into the oil shale strata above each tunnel and filled with explosives for blasting for sublevel caving.
Figure 2:
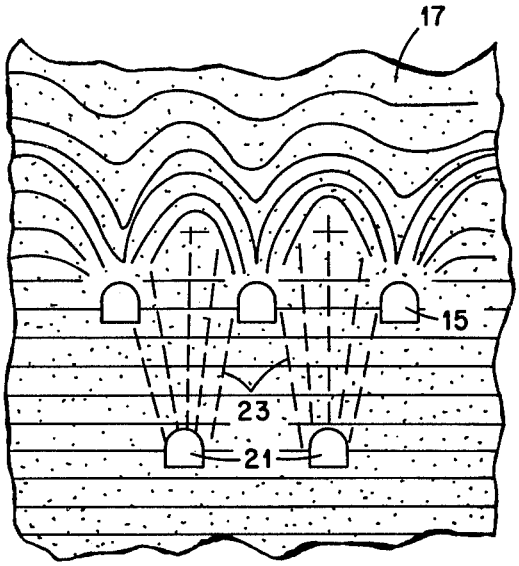
FIG. 2 is a cross-sectional transverse view of the tunnels of FIG. 1 after detonation of the explosives in the fan holes and with additional lower level tunnels drilled in the deposit with fan holes ready to receive explosives.
Figure 3:
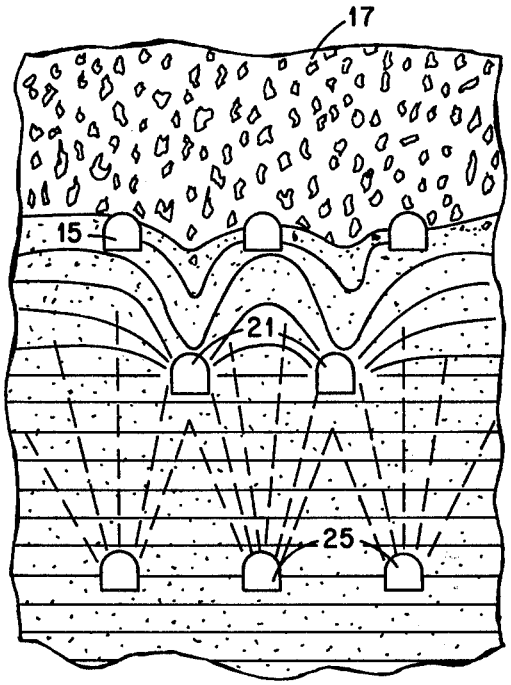
FIG. 3 is a cross-sectional transverse view of the tunnels of FIGS. 1 and 2 with additional lower level tunnels, all of the tunnels being shown in a different stage of rubblization, according to the invention.

Referring to the drawing there is shown in FIG. 1 a series of tunnels 15 driven horizontally into an oil shale deposit 17 that is comprised of alternate layers of rich and lean shale. At the distal end of the tunnel fan holes 19 are drilled and filled with explosives which are then detonated to carry out sublevel caving of the overlying shale. In FIG. 2, additional lower level tunnels 21 are shown driven into the deposit 17 and provided with fan holes 23 to be filled with explosives for detonation and sublevel caving of the overlying shale into the tunnels 21. As sublevel caving in the tunnels 15 progresses towards the proximate end of the tunnels, sublevel caving may be begun and carried out in the tunnels 21. Similarly, as shown in FIG. 3, additional lower level tunnels 25 may be drilled and sublevel caving performed while the upper level tunnels 15 and 21 are completed. An alternative way of blasting the tunnels and to obtain a more uniform size of rubble fragment is by driving the tunnels closer together horizontally and then drilling the holes for the explosives vertically upward.

Figure 4:
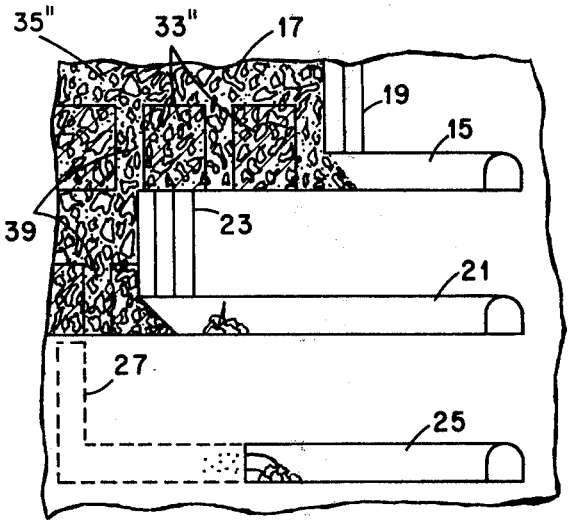
FIG. 4 is a cross-sectional longitudinal view of the tunnels of FIGS. 1, 2 and 3 during various stages of rubblization.

In FIG. 4, the tunnels 15, 21 and 25 are shown generaly in longitudinal cross section in various stages of completion of the rubblization process. All of the tunnels are begun, such as tunnel 25, with the tunnel completed to its full extent and then a slot 27 constructed at the end of the tunnel. All of the rubble from the construction of the tunnel 25 and slot 27 is extracted for surface retorting or disposal, leaving space into which subsequently blasted shale can expand. Tunnels 15 and 21 are shown in typical later stages of drilling, rubblization and partial extraction.

Figure 5:
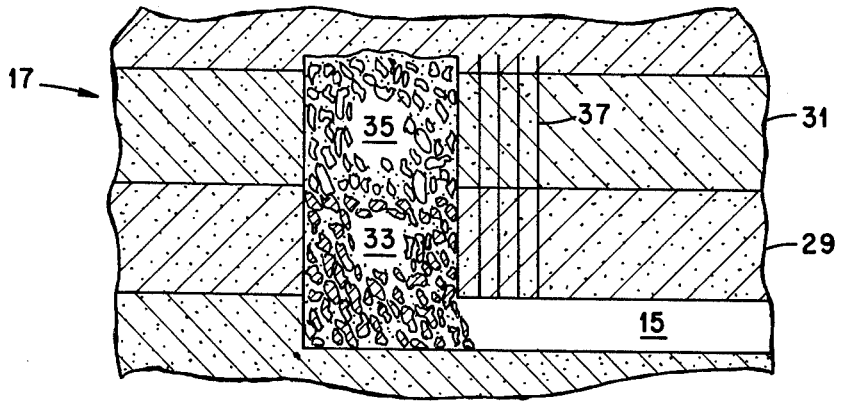
FIG. 5 is a cross-sectional longitudinal view of the distal end of a horizontal tunnel in a layered rich and lean oil shale deposit that has been partially rubblized and further drilled with fan holes ready to be filled with explosives for blasting for further rubblization.
Figure 6:
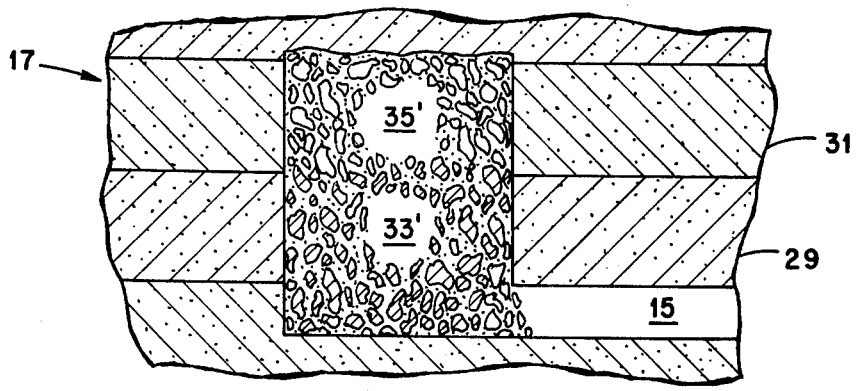
FIG. 6 is a view of the tunnel of FIG. 5 after the explosives have been detonated in the fan holes.
Figure 7:
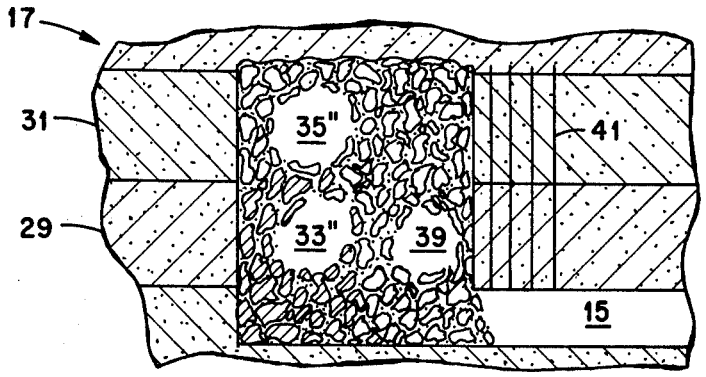
FIG. 7 is a view of the tunnel of FIGS. 5 and 6 following partial extraction of accessible rich rubble to permit the overlying lean rubble to drop to tunnel level.

In FIGS. 5, 6 and 7 is shown a typical tunnel, for example tunnel 15, in the shale deposit 17 in successive stages of development of rubblization and mixing of overlying rich and lean layers of shale 29 and 31 in the deposit. In FIG. 5, rich and lean rubble piles 33 and 35 are shown which have been developed by completing the tunnel 15 to its full extent, drilling and blasting an overhead slot at the end of the tunnel, removing the rubble from the tunnel and slot, and then fan drilling and blasting the shale overlying the tunnel and adjacent the slot. Fan drilled holes 37 are drilled next to the piles 33 and 35 to enable further blasting and expansion of the piles. Expanded piles 33' and 35' (FIG. 6) remain generally layered as in their natural state. Creation of alternate zones of rich and lean shale in the horizontal direction in the deposit may be accomplished, according to the invention, by removing to the surface the portion of the rich rubble 33' (FIG. 6) that is adjacent to the tunnel 15. This permits a portion of the lean rubble 35' to drop to the level of the tunnel 15 and form a column 39 (FIG. 7). Additional fan drilled holes 41 are drilled adjacent the column 39 for further blasting to allow rich shale to drop to tunnel level and then partial removal of rich shale to form additional columns of lean shale. Such additional columns 39 are shown in FIG. 4 as a series of columns 39 between piles of rich rubble 33'' and layers of lean shale rubble 35''. Alternatively, the tunnel 15 may be driven so that the immediately overlying shale is a lean layer and the columns 39 are of rich shale. Or, if the shale layer thicknesses are thin, the rubble piles 33 and 35 may consist of several layers of rich and lean shale, and the columns 39 formed by extracting the lower layer to offset the remaining layers to thereby interleave the rubble piles.

Figure 8:
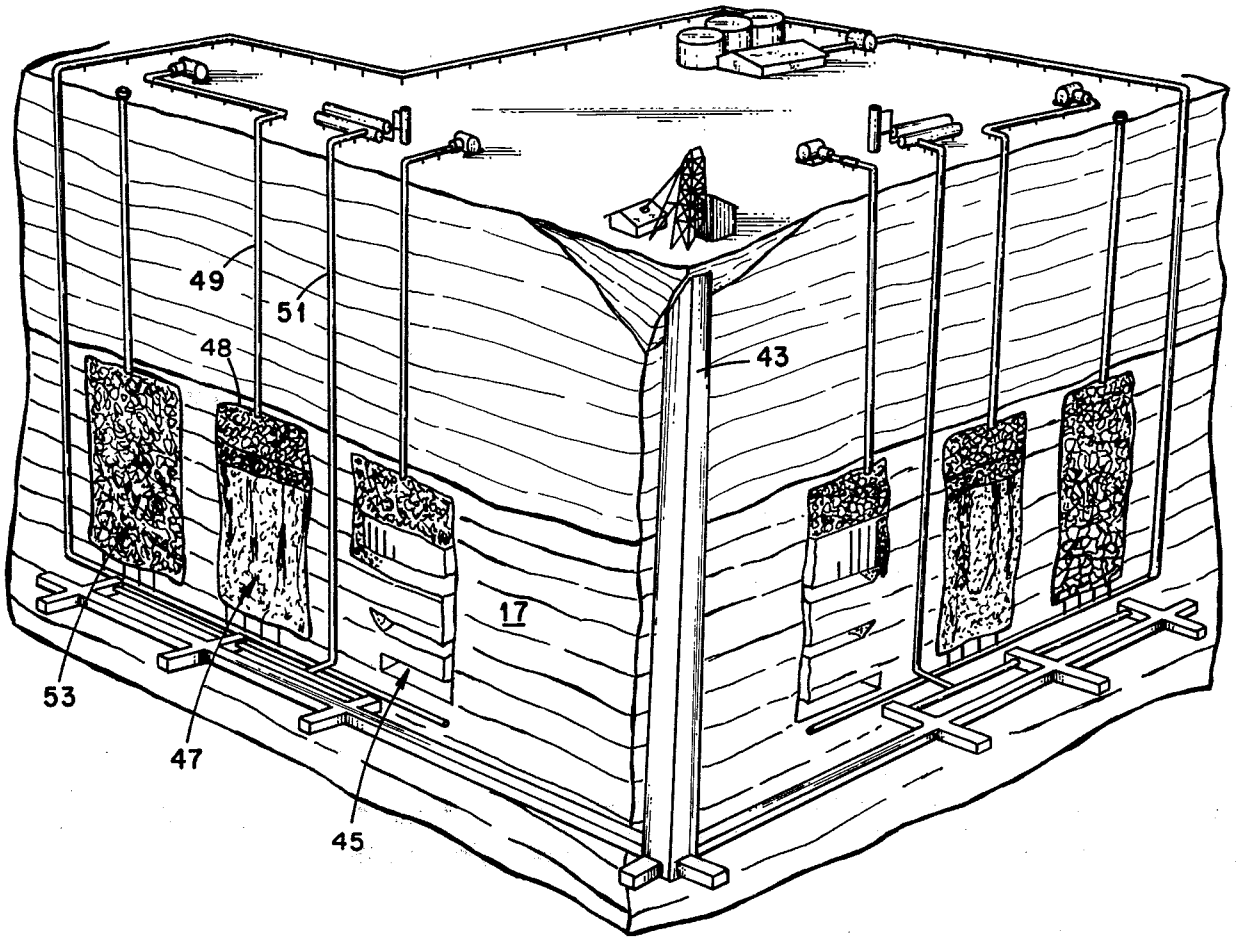
FIG. 8 is a comprehensive cross-sectional view of an oil shale deposit showing areas of the deposit at various stages of development for in situ retorting.

A comprehensive cross-sectional view of the typical deposit 17, including areas undergoing various stages of development of the deposit, is shown in FIG. 8. The development includes: a shaft 43 for access to the areas of the deposit; a block of shale deposit 45 under development; a block 47 being retorted with air being supplied through an inlet pipe 49 which connects to a plenum space 48 developed at the upper boundary of the block 47; a pipe 51 for bringing the products to the surface; and a block 53 that has been retorted.

Since oil shale deposits generally are comprised of rich and lean layers, the method of the present invention leads to substantial mixing, in a gross sense, of the rich and lean shale by formation of a series of columns 39 throughout the rubblized deposit, thereby minimizing the effect of plastic flow of rich shale at retorting temperatures, typically 400°–500° C, and high pressures, shale deposits are often in the range of 2000 feet thick. The rich shale starts to deform around 300° C, while the lean shale does not significantly compress or flow at retorting temperatures and rubble pile pressures so that hot fluid passages throughout the rubblized deposit are maintained open during retorting. The shale fragments are also formed of an optimum size to maintain open passages at the various depths by monitoring the fragment size during blasting at each level. Sublevel caving and partial rubble removal provides automatic access to rubble fragments for examination as to size so that the drilling and blasting of overlying shale layers may be continuously modified to attain the optimum size fragments.

While an embodiment of the invention has been shown and described, further embodiments or combinations of those described herein will be apparent to those skilled in the art without departing from the spirit of the invention.

What I claim is:

1. A method for preparing a block of an oil shale deposit for in situ retorting, the block being comprised of alternate layers of rich and lean shale, including the steps of:

developing a vertical access tunnel in the deposit;

driving a horizontal tunnel from the the access tunnel into the deposit;

performing sublevel caving of both rich and lean oil shale layers overlying the distal end of the tunnel to rubblize at least the two immediately overlying layers;

removing a sufficient amount of accessible rubblized shale in the tunnel to permit the rubblized layer adjacent the immediately overlying rubblized layer to drop to the floor level of the tunnel to thereby form a column of shale of different compressability than the horizontally adjacent shale;

performing additional sublevel caving towards the proximate end of the tunnel; and periodically removing accessible rubble of the immediately overlying layer to create additional columns of shale from the rubblized layer adjacent the immediately overlying layer to thereby form alternate zones of rich and lean shale to maximize the permeability of the oil shale block to hot fluids during retorting.

2. The method of claim 1, wherein said sublevel caving is performed by drilling a fan of holes in the shale overlying the tunnel, filling the holes with explosives, and blasting the shale with the explosives.

3. The method of claim 1, further including the steps of monitoring the size of the blasted shale fragments and adjusting the fan hole sizes and amount and placement of the explosives therein so that the fragments formed are of the optimum size during retorting of the block.

4. The method of claim 1, further including the steps of driving a slot upward at the distal end of the tunnel, and removing the fragments from the slot, to provide space for rubblized shale to expand into during the sublevel caving steps.

5. The method of claim 1, wherein a plenum space is developed at the upper boundary of the shale deposit block for receiving inlet air for supporting combustion of the rubble during retorting of the block.

6. The method of claim 1, wherein the horizontal tunnel is driven along the lower edge of the uppermost rich shale layer of the deposit and the columns of shale are comprised of lean shale.

7. The method of claim 1, further including the steps of driving a plurality of tunnels from the access tunnel into the deposit at the same level and parallel to the horizontal tunnel to form a series of tunnels spaced across the width of the block, performing sublevel caving in each of the parallel tunnels, and periodically removing accessible rubble of the immediately overlying shale layer in each of the parallel tunnels to create therein alternate zones of rich and lean shale rubble.

8. The method of claim 7, further including the steps of driving a plurality of series of tunnels from the access tunnel into the deposit at successively lower levels beneath the series of horizontal tunnels, performing sublevel caving in each of the parallel tunnels, and periodically removing accessible rubble of the immediately overlying shale layer in each of the lower level tunnels to create therein alternate zones of rich and lean shale rubble.

9. The method of claim 1, wherein said sublevel caving is performed by drilling vertical holes in the shale overlying the tunnel, filling the vertical holes with explosives, and blasting the shale with the explosives.

10. The method of claim 1, wherein the rich oil shale contains more than 25 gallons of oil per ton of shale and the lean oil shale contains less than 15 gallons of oil per ton of shale.

* * * * *